United States Patent [19]

Urlaub

[11] 4,290,396

[45] Sep. 22, 1981

[54] HEAT CONDUCTING SHIELD FOR CYLINDER HEADS OF INTERNAL COMBUSTION ENGINES

[75] Inventor: Alfred Urlaub, Nuremberg, Fed. Rep. of Germany

[73] Assignee: Maschinenfabrik Augsburg-Nuremberg Aktiengesellschaft, Nuremberg, Fed. Rep. of Germany

[21] Appl. No.: 30,899

[22] Filed: Apr. 17, 1979

[30] Foreign Application Priority Data

Apr. 19, 1978 [DE] Fed. Rep. of Germany ..... 2816923

[51] Int. Cl.[3] ..... F02F 1/26

[52] U.S. Cl. ..... 123/193 CH; 123/41.85; 123/188 GC; 123/188 VA; 123/669

[58] Field of Search ..... 123/48 R, 41.52, 41.76, 123/41.77, 41.85, 188 R, 188 VA, 188 GC, 191 R, 191 M, 191 A, 193 CH, 193 H, 193 R, 668, 669

[56] References Cited

U.S. PATENT DOCUMENTS 3,115,127 12/1963 Spencer et al. ..... 123/41.85
3,125,082 3/1964 Stansfield et al. ..... 123/193 CH

FOREIGN PATENT DOCUMENTS 2061930 7/1972 Fed. Rep. of Germany ... 123/193 H
8087651 1/1937 France ..... 123/191 M

*Primary Examiner*—Craig R. Feinberg
*Attorney, Agent, or Firm*—Becker & Becker, Inc.

[57] ABSTRACT

Heat conducting shield member for cylinder heads of internal combustion engines having at least two gas change ports with valve seat rings at their combustion chamber end, with the valve bridge portion between the valve seat rings shielded by the shield member against the combustion chamber. The shield member is formed as a heat conducting shield which in the area of the valve bridge portion between the bridge and the cylinder head wall forms a hollow space and is in full contact with the cylinder head in the area of cylinder head wall members which can be readily cooled.

10 Claims, 4 Drawing Figures

HEAT CONDUCTING SHIELD FOR CYLINDER HEADS OF INTERNAL COMBUSTION ENGINES

The present invention relates to heat conducting shield means for cylinder heads of internal combustion engines, wherein the cylinder head has at least two gas change ports with valve seat rings at the combustion chamber end, wherein the bridge portion between the valve seat rings is shielded by the shield means adjacent the combustion chamber and the cylinder heads including such heat conducting shield means.

As is well known, the cylinder heads of internal combustion engines are subjected to high thermal alternating stresses. Probably the most highly stressed point is the narrow bridge portion between two gas change ports, which has to be narrow for reasons of space alone and which, in addition, can be only insufficiently cooled in many cases. Due to the inevitable non-uniform heating of the cylinder head, high compressive stresses can arise in this bridge region, because the material forming this bridge portion tends to expand, but this expansion is prevented by the colder peripheral part of the cylinder head. As a result, upsetting of the bridge region will result even into the plastic range. During subsequent cooling, the compressive stresses will decrease again, and are eventually replaced by tensile stresses, also in the plastic range, due to the preceding upsetting in the cold condition. Upon completion of several of such stress cycles, initial cracks will occur which, during continued operation, will develop into through-cracks which not only will render the cylinder head unseviceable but, for instance in the case of water-cooled engines, may bring about complete destruction of the engine due to ingress of water into the cylinder.

Furthermore, stresses resulting from the varying load range of the engine are superimposed on the thermal stresses described. Moreover, the bridge region is subjected to additional stresses when, as is usual, an exhaust valve is arranged adjacent to an inlet valve, because the exhaust port attains considerably higher temperatures than the inlet port.

In order to prevent the formation of cracks in the bridge portion between two valves, it has been proposed to provide this area of the cylinder head bottom, facing the combustion chamber, with narrow expansion gaps which are approximately half as deep as the cylinder head bottom center. As a result, the stresses at the surface were compensated, but these expansion gaps were found to fill up with hard combustion residue and, thus, become ineffective after a short period of time. Apart from that, it was still not possible to completely obviate the formation of cracks in the valleys of the expansion gaps.

According to one proposal, the expansion gaps described were filled with a sheet metal structure embedded without metallic bonding in the cylinder head. While this prevented the gaps from filling up, this failed to obviate the formation of cracks in the valleys. Flanging of the sheet metal or structure with a relatively small radius in the valley of the expansion gap failed to change this.

Pursuing the same idea, according to another proposal an arrangement has been disclosed according to which the expansion gaps at their valleys blend into a lightly concave arc, symmetrical to a plane extending at right angles to the longitudinal axis of the cylinder at the cylinder end. In other words, the expansion gaps are made to turn similarly into the plane in which the stresses act and continue in this general direction without any abrupt change of direction over an appreciable length. The T-shaped or angle-shaped expansion gaps, also lined with sheet metal, did bring about a further improvement, but it has not been possible to completely obviate the stresses in the interior of the valve bridge, and it was found that cracks continue to develop. Also it has been found that this proposed idea is relatively difficult to translate into practice and, therefore, actual construction proved expensive compared to the benefits obtained.

According to another proposal a cylinder head has been disclosed in which each seat ring at the side of the outer surface forming the greater diameter facing the adjacent seat ring is formed with a planar face extending parallel to the axis of the recess. The seat rings are press-fitted in recesses of the cylinder head in a manner that their planar faces are in solid contact. Manufacture of this design has proved to be complex, because no gap is to occur, while, on the other hand, any occurring stresses must not be too high.

Finally, as described initially, a cylinder head was disclosed wherein the bridge portion between the valve seat rings is protected by a plate, specifically a heat protection shield, from the direct effects of combustion. This heat protection plate is either slid into guides from one of the gas change ports or from the cylinder head wall turned into place and secured and/or located by the seat rings. It consists of heat resistant material and is just large enough to cover the endangered zone. Such an arrangement, while protecting the bridge portion from the direct effects of combustion, will permit arising heat to be transmitted into the bridge portion from which location it dissipates only with great difficulties.

It is an object of the present invention to improve a cylinder head of the type described above in such a way that the drawbacks referred to can be avoided by simple means, and with satisfactory heat dissipation from the area of the bridge portion being obtained by means of which the occurrence of cracks in the valve bridge portion is obviated.

This object and other objects and advantages of the invention will appear more clearly from the following specification in connection with the accompanying drawings, in which.

The invention is primarily characterized by a heat conducting shield member which can be provided in the area of the bridge portion between valve ports, which forms a hollow space thereat, and which is in full contact in the area of cylinder head wall members which are easy to cool.

The hollow space mainly serves the purpose of preventing heat from being transmitted into the bridge in the first place, or to permit heat to be transmitted only to the extent so as not to be harmful. Generally, heat is transmitted in the heat conducting shield and will pass into the cylinder head only in the areas which are in solid contact with the cylinder head wall, to be directly transferred to and removed by the coolant. Consequently, the valve bridge portion itself can no longer be subjected to excessive stresses. It is axiomatic that in the area of the cylinder head wall members, which can easily be cooled, the heat conducting shield member should be formed with as wide a surface as possible.

In order to prevent interference with fuel mixture formation and combustion and to avoid carbon deposits, it is proposed, according to the invention, to insert the heat conducting shield in a recess provided in the cylinder head wall and to secure it by screws, welding, shrinking or similar methods in a manner that it is flush with the cylinder head bottom.

The hollow space itself is preferably formed by a recess in the heat conducting shield, said recess taking the form of a longitudinal groove extending in the direction of a straight line connecting the centers of the valve seats, or formed to open only in the direction of the cylinder head wall. In the area of the valve bridge portion, the heat conducting sheild should also, in order to prevent carbon deposits, be in contact with the outer diameters of the valve seat rings.

When very high thermal stresses are likely to occur in the heat conducting shield, it is furthermore proposed that the shield be divided in a plane perpendicular to the straight line connecting the centers of the valve seat rings and either to have the two parts overlapping or abutting with only a narrow expansion gap therebetween.

Figure 1:
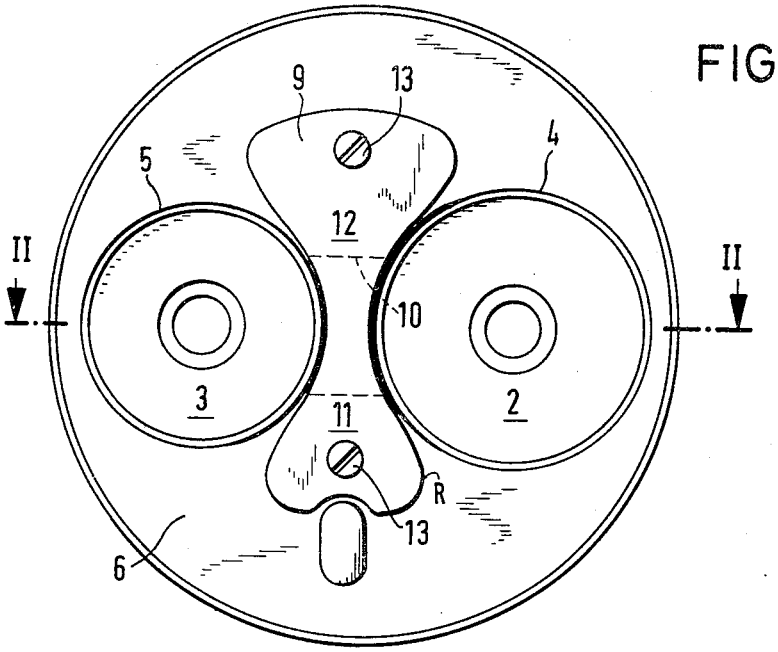
FIG. 1 is a plan view of a cylinder head of an embodiment according to the invention viewed from the side of the combustion chamber.
Figure 2:
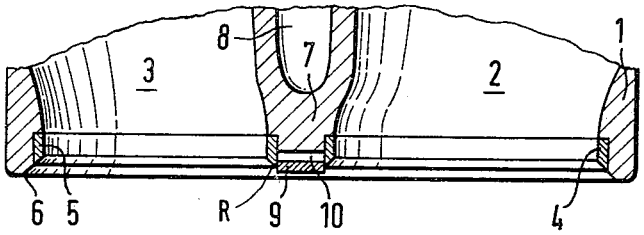
FIG. 2 is a section along line II—II in FIG. 1.

Referring now particularly to FIGS. 1 and 2 of the drawings, a cylinder head 1, shown only in part, is formed with gas change ports comprising an inlet port 2 and an exhaust port 3 which, at the combustion chamber end, are provided with valve seat rings 4, 5. The surface of the cylinder head facing the combustion chamber is denoted by the numeral 6. Between the gas change ports 2, 3 there is a relatively narrow bridge portion of the cylinder head 1, denoted by the numeral 7, which bridge portion 7, as is generally accepted, represents the most highly stressed location, where cracks are prone to occur since, in addition, it is not possible to provide sufficient cooling here because, for structural reasons, the coolant space denoted by numeral 8 cannot be extended any closer to the valve seat rings 4, 5. This valve bridge portion 7 is covered by a heat conducting shield 9 which is provided, in the critical area, with a recess 10 forming an insulating, hollow space. The heat conducting shield is shaped with as large a width as possible at the cylinder head wall members 11, 12, which wall members are readily subjected to efficient cooling. As shown in FIG. 2, the heat conducting shield is secured here in a recess R provided in the cylinder head wall 6, to be flush with the cylinder head bottom, my means of screws 13. In the area of the valve bridge portion 7, the heat conducting shield contacts the outer faces of the valve seat rings 4, 5 and, thus, forms a protective shield. In this manner, effective heat dissipation is provided, from the area of the valve bridge 7, into areas where efficient heat removal is possible.

Figure 3:
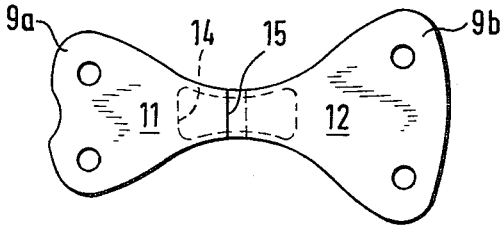
FIG. 3 shows in plan view a heat conducting shield of another embodiment viewed from the side of the combustion chamber.
Figure 4:
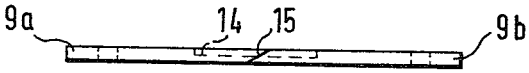
FIG. 4 is a side elevational view of the embodiment shown in FIG. 3.

FIGS. 3 and 4 only show a different embodiment of the heat conducting shield member with the recess 14 forming the insulating hollow space. The recess 14 is closed at its sides and only open towards the valve bridge portion 7. The heat conducting shield according to this embodiment, furthermore, consists of two members 9*a*, 9*b*, which are in overlapping relation substantially at the center of bevel surface 15, or can be made to butt with a narrow expansion gap being provided therebetween. This embodiment can be used particularly successfully where high thermal stresses occur.

Finally, several recesses, such as those indicated at 10 and 14, may be provided, for instance, when it is intended, as well, to shield the injection nozzle.

It is obvious that the heat conducting shield could be arranged at any other location of the cylinder head liable to be affected and that it may have absolutely different shapes. Thus it is perfectly feasible also to provide some cutouts at certain locations which are not suitable for heat dissipation.

The present invention is, of course, in no way restricted to the specific disclosure of the specification and drawings, but also encompasses any modifications within the scope of the appended claims.

What I claim is:

1. In combination, a cylinder head including a side which faces an interior of an engine cylinder for internal combustion engines having a combustion chamber with the interior relative to which at least two gas change ports with centers are provided with valve seat rings at combustion chamber end of the ports, a valve bridge portion between the valve seat rings having outer faces; a heat conducting shield including cylinder head wall members readily subjected to efficient cooling for shielding only the valve bridge portion provided between at least the two gas change ports, said heat conducting shield including the wall members being located on that side of the cylinder head which faces the interior of the cylinder, and said heat conducting shield being provided with a cutout portion for forming an enclosed insulating hollow space between said heat conducting shield including the wall members and said side cylinder head which faces the interior of the cylinder, said head conducting shield being in full contact with the cylinder head in the area of said cylinder head wall members which can be readily cooled wherein said cutout portion includes a recess which in turn includes a longitudinal groove extending with its longitudinal axis in a direction normal to and beyond that of a line intersecting centers of said at least two valve ports.

2. A combination according to claim 1, wherein said shield is in contact with pertaining valve seat rings in said ports at least in the region between said at least two gas change valve ports.

3. A combination according to claim 1, wherein said cylinder head includes a matching depression, and wherein said shield is securable in said depression by means selected from the group consisting of screw fasteners, welding securement, and shrink fastening means.

4. A combination according to claim 1, wherein said shield is wider near said wall members than near said cutout portion.

5. A combination according to claim 1, wherein said cutout portion opens in the direction towards said cylinder head.

6. A combination according to claim 1, which includes means for operatively connecting other components of the combustion engine to the interior of the cylinder.

7. A combination according to claim 1 wherein said heat protection shield is made of heat resistant material and is at least just large enough to cover the valve bridge portion endangered by thermal and high compressive stresses which otherwise develop cracks in the cylinder head and valve bridge portions due to non-uniform heating of the cylinder head.

8. A combination according to claim 1, wherein said shield includes a central split for high stresses.

9. A combination according to claim 8, wherein said shield is split into two parts with bevel end faces which overlap in that portion of a cylinder head between said at least two valve ports with the planes of overlapping end faces extending along an imaginary line connecting the centers of said at least two valve ports.

10. A combination according to claim 9, wherein the overlapping end faces form an expansion gap.

* * * * *